United States Patent [19]

Ernst et al.

[11] 4,451,232

[45] May 29, 1984

[54] NOZZLE BLOCK FOR ROTARY KILNS

[75] Inventors: Helmut Ernst; Karl-Heinz Gehrhardt, both of Dietzenbach; Leopold Uhl, Camberg; Hartmut Wolert, Frankfurt am Main, all of Fed. Rep. of Germany

[73] Assignee: Metallgesellschaft Aktiengesellschaft, Frankfurt am Main, Fed. Rep. of Germany

[21] Appl. No.: 406,670

[22] Filed: Aug. 9, 1982

[30] Foreign Application Priority Data

Sep. 18, 1981 [DE] Fed. Rep. of Germany ..... 3137122

[51] Int. Cl.[3] ..... F27B 7/00; B05B 15/00

[52] U.S. Cl. ..... 432/103; 239/397.5

[58] Field of Search ..... 432/103; 239/397.5

[56] References Cited

U.S. PATENT DOCUMENTS 2,480,255 8/1949 Mortson et al. ..... 239/397.5

3,001,779 9/1961 Williams ..... 239/397.5

FOREIGN PATENT DOCUMENTS 2353331 5/1974 Fed. Rep. of Germany ..... 432/103

*Primary Examiner*—John J. Camby

*Attorney, Agent, or Firm*—Strung, Horn, Kramer & Woods

[57] ABSTRACT

In order to reduce the wear and to facilitate the replacement, a nozzle block comprises a mounting plate which is connected to the kiln shell, a nozzle tube which extends in the mounting tube and defines a clearance with the mounting tube and with the kiln lining, an abutment surface provided at the lower end of the nozzle tube and engaged by the orifice plate and which is clear of the body of the nozzle tube, a retaining tube which extends in the nozzle tube and defines a clearance with the nozzle tube and with the orifice plate, a gas feed duct attached to the side of the mounting tube and a cover on the mounting tube.

6 Claims, 1 Drawing Figure

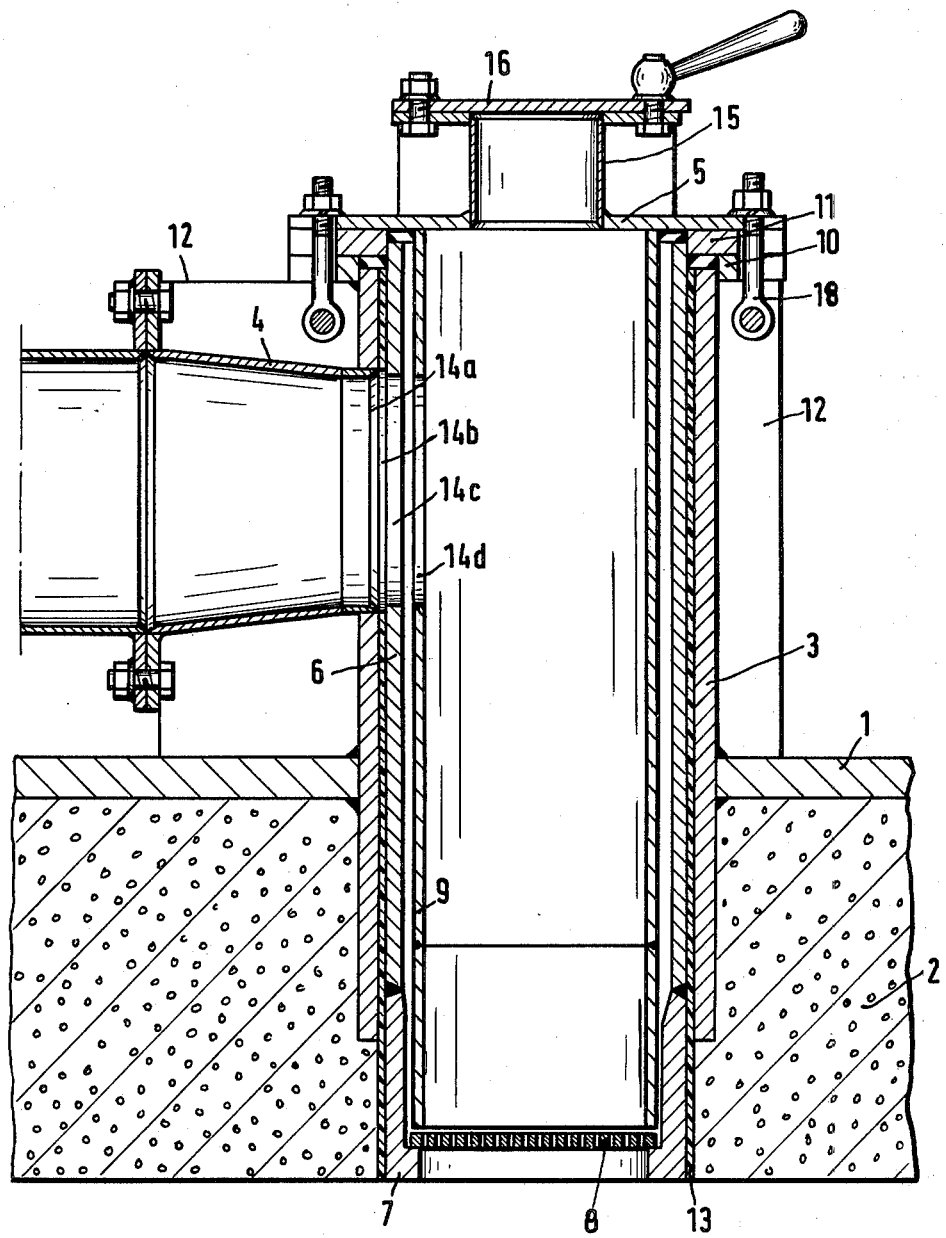
16
15
5
11
10
18
12
4
14a
14b
14c
14d
12
3
6
1
9
2
7
8
13

NOZZLE BLOCK FOR ROTARY KILNS

BACKGROUND OF THE INVENTION

The present invention relates to a nozzle block for rotary kilns, comprising a mounting tube, which extends through and is connected to the shell of the rotary kiln, a gas feed duct secured to the side of the mounting tube, a cover detachably secured to the outer end of the mounting tube, a nozzle tube, which extends in the mounting tube and through the kiln lining, and an orifice plate in the lower portion of the nozzle tube.

Nozzle blocks are gas feeders which extend through the wall and the refractory lining of the rotary kiln and have outlet openings which are flush with the inside peripheral surface of the refractory lining or disposed slightly outwardly or inwardly of said surface. Those tubes of the nozzle blocks which extend through the shell and the refractory lining of the kiln consist generally of metallic materials. The orifice plate having orifice slots or holes may consist of metallic or ceramic materials. In most cases radially extending nozzle blocks provided at a given injecting location are spaced apart in the peripheral direction in an annular series. Gaseous fluids, such as oxidizing, reducing or combustible gases, or carrying gases for entraining liquid or solid materials, are injected through the nozzle blocks into the rotary kiln. These fluids may be injected only into the charge, or only into the free space within the kiln, or throughout the revolution of the kiln.

Such nozzle blocks are used particularly in the direct reduction of iron oxides to produce sponge iron and in the calcining of limestone.

Whereas shell tubes or shell burners extend radially approximately as far as to the axis of the rotary kiln so that their outlet openings are always disposed in the free space within the kiln, nozzle blocks are covered by the charge during each revolution of the kiln. For this reason the orifice in the orifice plates may become clogged. Besides, the orifice plates are subjected to high mechanical stresses and to thermal stresses due to temperature changes. As a result, the orifice plates must often be replaced.

German patent publication DE-PS No. 606,168 discloses nozzle blocks comprising a nozzle tube, which extends through the shell and lining of the kiln and is directly connected to said lining. The gas feed duct is centrally secured to the cover of the nozzle tube, which at its inner end has an inwardly directed flange, on which the orifice plate is supported. A retaining tube is secured to the cover and forced against the outside surface of the orifice plate. As the nozzle tube is directly connected to the lining, it can be replaced only with difficulty and the lining may be damaged by the stresses which may arise. Besides, the nozzle tube must consist of high-grade material throughout its length. The orifice plate may become bonded to the nozzle tube so that it is then difficult to replace the orifice plate. In cases of repairs, the gas feed duct must be removed.

German patent publication No. 23,53,331 discloses nozzle blocks comprising a mounting tube, which is secured to the shell of the kiln, a gas feed duct mounted on the side of the mounting tube and a nozzle tube, which is inserted into the mounting tube radially inwardly of the gas feed duct and extends to the inside surface of the lining and is connected to the mounting tube by screws or bolts. The mounting tube is closed at its outer end by a detachable cover. The orifice plate is secured to a rod, which extends through the cover and is detachably secured to the latter. The rod decreases the free area of the orifice plate. The nozzle tube must be laterially connected to the mounting tube by screws so that there is a danger of canting and of an irregular temperature distribution, which may result in a formation of cracks. The mounting and removal is difficult and the orifice plate cannot be pulled out alone. Besides, the orifice plate may engage the nozzle tube only on one side.

SUMMARY OF THE INVENTION

It is an object of the invention to avoid the disadvantages of the known nozzle blocks and particularly to provide a nozzle block which has a minimum wear and the wearing parts or soiled parts of which can be replaced quickly and in a simple manner.

This object is accomplished according to the invention in that the nozzle tube defines a clearance with the mounting tube throughout the length of the body of the latter and defines a clearance with the furnace lining and is detachably connected at its outer end to the mounting tube. The nozzle tube is provided at its inner end with an abutment surface surface, which is engaged by the orifice plate, which defines a clearance with the body of the nozzle tube, and the nozzle tube contains a retaining tube, which defines a clearance with the nozzle tube and with the orifice plate which lies on the abutment surface.

At the location of the gas feed duct, the mounting tube, the nozzle tube and the retaining tube are formed with respective openings so that the gas can flow into the retaining tube and then through the orifice plate. The mounting tube may be stiffened by radial ribs provided on its outside. Screws are suitably employed to detachably secure the cover, nozzle tube and mounting tube to each other. The abutment surface provided at the inner end of the nozzle tube, which end is disposed in the kiln, is suitably formed by an inwardly directed flange. The orifice plate engaging that abutment surface may consist of metallic or ceramic material. The mounting tube may extend only to the inside surface of the shell of the kiln or into the lining of the kiln. The clearances mentioned should be so large that the parts defining said clearances will not be strained at the highest possible temperature. The cover may be provided with a sight hole.

In accordance with a preferred further feature, the retaining tube is secured to the cover. This permits a good fixation and quick removal of the retaining tube. Alternatively, the retaining tube may be loosely arranged in the nozzle tube or secured to the orifice plate.

In accordance with a further preferred feature the mounting tube and the nozzle tube are provided with flanges at their outer ends. This feature permits a simple and reliable connection of the tubes and the cover to each other. The flanges of the mounting tube and of the nozzle tube may be interconnected by screws and the cover may then be secured by coupling screws although all three parts may be connected by the same screws.

In accordance with a further preferred feature, the clearance which is defined by the nozzle tube with the mounting tube and with the lining is filled with soft insulating material. This will prevent an ingress of fine-grained material into said clearance and will ensure a good fixation and easy replacement.

In accordance with a further preferred feature, the inner portion of the nozzle tube has a larger wall thickness or is made from a higher-grade material than the outer portion of the nozzle tube. This feature reduces the wear and involves only a small expenditure of materials. The inner portion of the retaining tube may also consist of a higher-grade material than the outer portion of the retaining tube.

BRIEF DESCRIPTION OF THE DRAWING

The invention will be explained in more detail with reference to the accompanying drawing wherein the FIGURE shows a nozzle block in cross-section.

DETAILED DESCRIPTION OF THE INVENTION

The shell 1 of the rotary kiln is provided on the inside with a lining 2. The cylindrical mounting tube 3 is welded to the shell 1 and extends through part of the lining 2. A gas feed duct 4 is connected to the side of the mounting tube 3. A cover 5 is secured to the outer end of the mounting tube 3. A cylindrical nozzle tube 6 extends in the mounting tube 3 and through the lining 2 and defines a clearance with the mounting tube 3 and with he lining 2. The nozzle tube 6 is provided at its inner end with the inwardly directed flange, which has an abutment surface 7. The latter is engaged by the orifice plate 8, which is clear of the body of the nozzle tube 6. The retaining tube 9 extends in the nozzle tube 6 and is secured to the cover 5 and defines clearances with the nozzle tube 6 and with the orifice plate 8. Flanges 10, 11 are provided at the outer end of the mounting tube 3 and the nozzle tube 6 and are interconnected by screws, not shown. The mounting tube 3 is provided on its outside with stiffening ribs 12. Coupling screws 18 are secured to the ribs 12 and serve to secure the cover 5 to the flanges 10, 11. Soft insulating material 13 is disposed in the clearance defined by the nozzle tube 6 with the mounting tube 3 and the lining 2. On the same side as the feed duct 4, the mounting tube 3, nozzle tube 6, retaining tube 9 and insulating material 13 are formed with respective passage openings 14*a* to 14*d*. The cover 5 has a sight hole 15, which is provided with a hinged plate 16. The inner end portion of the nozzle tube 6 consists of higher-grade material and/or has a larger wall thickens than the remaining portion of the nozzle tube and is welded thereon as shown.

The advantages afforded by the invention reside in the parts which are subjected to wear, namely, the nozzle tube and the orifice plate, can be replaced quickly and in a simple manner individually and jointly, that the orifice plate can be cleaned or replaced quickly, and that the wear of these parts and of the kiln lining through which the nozzle tube extends is minimized.

It will be appreciated that the instant specification and claims are set forth by way of illustration and not limitation, and that various modifications and changes may be made without departing from the spirit and scope of the present invention.

What is claimed is:

1. In a nozzle block for a rotary kiln having a shell, a lining, a mounting tube which extends through and is connected to the shell, a gas feed duct secured to the side of the mounting tube, a cover detachably secured to the outer end of the mounting tube, a nozzle tube which extends in the mounting tube and through the kiln lining and an orifice plate in the lower portion of the the nozzle tube, the improvement wherein: the nozzle tube forms a clearance with the mounting tube throughout the length of the body of the latter and a clearance with the furnace lining, means detachably connecting the nozzle tube at its outer end to the mounting tube, the nozzle tube comprises an abutment surface at its inner end which is engaged by the orifice plate which forms a clearance with the body of the nozzle tube and a retaining tube in the nozzle tube which forms a clearance with the nozzle tube and with the orifice plate lying on the abutment surface, and the mounting tube, the nozzle tube and the retaining tube have openings therein at the gas feed duct to permit gas to flow into the retaining tube and through the orifice plate.

2. The nozzle block according to claim 1, further comprising means securing the retaining tube to the cover.

3. The nozzle block according to claim 1 or 2, wherein the mounting tube and the nozzle tube are provided with flanges at their outer ends.

4. The nozzle block according to claim 1, wherein the clearance formed by the nozzle tube with the mounting tube and with the lining is filled with soft insulating material.

5. The nozzle block according to claim 1, wherein the inner portion of the nozzle tube has a larger wall thickness than the outer portion of the nozzle tube.

6. The nozzle block according to claim 1 or 5, wherein the inner portion of the nozzle tube is made of a higher-grade material than the outer portion of the nozzle tube.

* * * * *